United States Patent [19]

Monsheimer et al.

[11] 3,986,926

[45] Oct. 19, 1976

[54] METHOD FOR PREPARING TANNABLE PELTS FROM ANIMAL SKINS AND HIDES

[75] Inventors: Rolf Monsheimer, Darmstadt-Eberstadt; Ernst Pfleiderer, Darmstadt-Arheilgen, both of Germany

[73] Assignee: Rohm GmbH, Darmstadt, Germany

[22] Filed: Jan. 9, 1974

[21] Appl. No.: 432,086

[30] Foreign Application Priority Data

Jan. 13, 1973 Germany ..... 2301591
Feb. 16, 1973 Germany ..... 2307603

[52] U.S. Cl. ..... 195/6
[51] Int. Cl.[2] ..... C14C 1/06
[58] Field of Search ..... 195/5, 6; 8/94.1 A, 8/94.16, 94.18

[56] References Cited

UNITED STATES PATENTS

| | | | |
|---|---|---|---|
| 2,041,731 | 5/1936 | Wallerstein et al. | 195/6 |
| 2,988,488 | 6/1961 | Robison | 195/6 |

OTHER PUBLICATIONS

Hetzel et al., "Use of Dimethylamine in Hair-Destroying Processes," J. Am. Leather Chemists Assn., July 1965, pp. 364–381.

*Primary Examiner*—A. Louis Monacell
*Assistant Examiner*—R. B. Penland
*Attorney, Agent, or Firm*—Curtis, Morris & Safford

[57] ABSTRACT

A method for preparing tannable pelts from animal skins or hides, said method effecting concurrent softening, dehairing, opening of the hide structure, and bating in a single procedural step, which method comprises treating said skins or hides, free of preserving salt, with an aqueous bath having a pH between about 9 and about 12 and having dissolved therein:

a. an effective amount of at least one member selected from the group consisting of a fungus protease whose optimum efficacy towards casein is at a pH above 7.0, and which protease may be replaced in whole or in part by trypsin and/or papain and/or by a bacterial protease whose maximum efficacy lies at a pH from 6 to 9;

b. an effective amount of a bacterial protease having an optimum efficacy against hemoglobin at a pH above 9; and c. an effective amount of a short-chained, primary or secondary aliphatic amine.

6 Claims, No Drawings

METHOD FOR PREPARING TANNABLE PELTS FROM ANIMAL SKINS AND HIDES

The present invention relates to a method for preparing tannable pelts by treating animal skins and hides with a proteolytic enzyme, in the presence of an activator, whereby softening, dehairing, opening of the hide structure, and bating are effected in one operational step.

It is known in the art that skins and hides are only very seldom treated in a tannery directly after slaughter as so-called "green" hides. In general, they are first preserved, most usually by salting, so that they can be stored in bundles and, if necessary, can be transported over large distances without being attacked by putrifaction. The salted and dried raw hides are treated in the beamhouse, i.e. at first by softening in order to return them into the condition of the original green hides. After softening, hair loosening takes place in a separate bath using an enzymatic process. Thereafter, dehairing follows by machine stripping of the hair from the grain. In a subsequent alkaline liming, the skin substances forming the leather are swollen and the hide structure is thereby opened for tanning. At the same time, by the addition of a reducing substance such as sodium sulfide, sodium sulfhydrate, and the like, for example, residual hair roots and short hairs are jellified. In the swollen condition, the sub-dermal connective tissue is removed by machine from the flesh side. On deliming and bating, neutralization occurs whereby, by a decrease in swelling, the swollen skin again reaches its natural hydration state and proteinaceous materials which have not yet been removed, such as albumin, globulin, melanine, keratin, procollagen, tropocollagen, and mucopolysaccharides, which can unfavorably influence the quality of the leather and which are, in technical terminology, referred to as "scud", can be removed.

Since the discovery by Otto Roehm that hides could be bated under the influence of an aqueous extract of the pancreas (German Pat. No. 200,519, granted in 1907), enzymes have found extensive use in the conversion of hides and skins into pelts ready for tanning, beginning with the softening process, continuing through dehairing, opening of the hide structure, and bating. In the softening process, proteolytic enzymes promote rehydration by decomposition of the aforementioned unstructured proteins.

In choosing a dehairing process, the question of whether the hair is to be chemically destroyed or should be retained is of decisive significance. In a lime-painting operation, i.e. the application of a lime-sodium sulfide slurry onto the hair side of a spread skin, in lime-sulfur-sodium pit liming, and also in the so-called sulfide-free liming, the hair is completely destroyed, whereas the hair is as a rule not destroyed in enzymatic dehairing. With lime-painting and also with the use of lime and alkali sulfide in subsequent liming, in contrast with enzymatic dehairing, there is a loading of the drainage canal with sulfide-containing waste waters as well as with waste waters having a high biological oxygen demand, so that for this reason alone enzymatic treatment is to be preferred. The efficacy of proteolytic enzymes depends on a loosening of the basal layer of the epidermis as well as of the underlying hair roots. The hair or wool must be removed from the skins or hides mechanically after conclusion of the enzyme treatment. Until now, it has not been possible to remove the short hairs completely from hides or skins during enzymatic dehairing. Rather, their removal must be done during the subsequent opening of the hide structure which usually takes place under alkaline conditions.

The dehaired and limed pelts are subsequently neutralized and bated, whereby the skin, which has been swollen by the alkaline liming process, should be returned again to its natural hydration condition. Because of the so-called "swelling hysteresis" of the skin, it is not possible during neutralization completely to overcome the swelling caused by liming. More often, a bating process usually proceeding under the influence of proteolytic enzymes is required.

Enzymes develop their efficacy, as is known in the art, in various definite pH regions. As described in German Pat. No. 927464, enzymatic softening can take place in the acid region or, according to German Pat. No. 2,059,453, in a strongly alkaline region. A requirement in both cases is, naturally, a choice of such proteolytically active enzymes whose maximum efficacy lies in the acid or alkaline region.

Also in dehairing, one may work in the acid or the alkaline region by a corresponding choice of the proteolytic enzymes to be employed. To the extent that hides to be dehaired are treated with enzymes in a weakly acid to weakly alkaline medium, say in a pH region between 5 and 9, special precautions must be taken in order to prevent an undesirable growth of bacteria in the bath or on the skins. According to the process in German patent publication No. 1,800,891, this disadvantage is overcome by working in a strongly acid region and employing pepsin or papain, for example, as the proteolytic enzymes. It must, however, be mentioned that an exclusively enzymatic dehairing in the treatment of cattle hides has not been possible because the action of fungus proteases in the acid region does not give pelts free of short hair. However, when treatment is carried out with proteases which are effective in a pH region greater than 10, the grain of the skin is attacked, resulting in the development of a suede effect or even to a dissolution of the grain with the formation of pits in the flanks.

Proteases whose optimum efficacy is in the alkaline region, namely at a pH value greater than 9, have only acquired considerable technical significance in the last few years. The preparation and use of such "alkaline proteases" is described in German patent publication No. 1,800,508 (corresponding to U.S. Pat. No. 3,723,250, granted Mar. 27, 1973). In this publication, the use of proteolytic enzymes in dehairing agents is disclosed, as well as the use of such enzymes in washing agents, agents for washing dishes, and the like.

In order to achieve satisfactory results in the preparation of tannable pelts from optionally salted raw skins according to the previous state of the art, it was necessary to carry out the beamhouse operations in succession, and in each case under certain definite pH conditions and with a choice of various optimally effective proteolytic enzymes. If hair softening and liming, on the one hand, and neutralization and bating, on the other hand, can occasionally overlap, alkaline liming and neutralizing or acid bating and a corresponding use of "alkaline" proteases in one case and of "acid" proteases in the other case in general have heretofore been processes clearly separated one from the other. Heretofore, no process has been known in which softening, dehairing, opening of the hide structure, and bating could take place in a single process, that is in a single vat or in a mixer under the influence of the same enzyme mixture. Such as process, proceeding in one method step and heretofore considered impossible to carry out, is a feature of the present invention.

It has now been found that tannable pelts can be prepared under the influence of proteolytic enzymes on aminal skins and hides in one operation involving softening, dehairing, opening of the hide structure, and bating if raw hides, freed of preserving salt by washing, are treated in a vat or mixer with an aqueous bath, adjusted to a pH value between 9 and 12, containing the following substances:

a. a fungus protease whose optimum efficacy towards casein lies at a pH value greater than 7.0;

b. a bacterial protease having an optimum efficacy against hemoglobin at a pH greater than 9;

c. a short-chained, primary or secondary aliphatic amine;

d. an organic sulfur compound having a reducing effect.

For component (a), fungus proteases of the type under consideration are obtained, for example, as soluble enzyme complexes together with amylase, cellulase, and various glycosidases as accompanying enzymes from Aspergillus cultures, particularly from cultures of *Aspergillus niger* or *Aspergillus flavus*. The aforementioned fungus proteases may be replaced in whole or in part with trypsin and/or papain and/or by a bacterial protease whose maximum efficacy against casein lies at a pH from 6 to 9. Such bacterial proteases are formed, for example, by *Bacillus subtilis* of the Mesentericus group, by *Bacillus natto*, *Streptomyces griseus*, *Bacillus cereus*, and *Bacillus mycoides*.

For component (b), the preparation of bacterial proteases which are maximally effective in a more strongly alkaline region is described in extensive detail in aforementioned German patent publication No. 1,800,508. In German patent publication No. 1,811,000, the formation of proteases optimally effective in the alkaline region from the bacterial organism *Bacillus subtilis*, as well as from certain Streptomyces types is described. According to German patent publication 1,807,185, the strain of *Bacillus alcalophilus* also produces proteases whose activity maximum lies in the aforementioned alkaline region. The proteinase complexes prepared from *Bacillus subtilis* have proved to be particularly advantageous. The alkaline bacterial protease is used, calculated on an enzyme product with 100,000 LVU, in quantities from about 0.01 to 0.3 percent. The alkaline fungus protease, or the enzyme chosen in its place - also employed as an enzyme product with 100,000 LVU —, is used in quantities from 0.02 to 0.5 percent. The percentages given are by weight of the salted hides.

For component (c), monomethylamine, dimethylamine, monoethylamine, diethylamine, monoethanolamine and/or diethanolamine can be used as activators for the enzyme mixture according to the invention. Of these amines dimethylamine is employed to particular advantage. Said amines are advantageously employed in quantities from 0.1 to 2 percent.

For component (d), exemplary organic sulfur compounds having a reducing effect are mercaptans, e.g. thioethanol and thiopropanol, as well as thioglycollic acid and its salts, thiourea, and cystine hydrochloride, in quantities from 0 to about 1 percent.

The establishment in the bath of the necessary pH value of from 9.0 to 12.0 can take place in known fashion, for example by the addition of caustic soda or hydrated lime and, advantageously, by the addition of a mixture of these two alkalinizing agents.

The bath frequently contains sodium sulfate previously blended with the enzymes to facilitate dosing of the latter.

As to the amount in which the fungus protease and bacterial protease of the aforementioned types can be employed, it is mentioned that this depends on the provenance and condition of the skins and hides to be treated. Although the amount varies over wide limits, it nevertheless can be determined by preliminary testing that can be easily carried out. It has in every case proved to be advantageous to use the fungus protease in an amount which predominates over the bacterial protease, for example in a ratio of 3:1, using the enzymatic efficacy of the two protease types as a measure for the amount to be employed. The aforementioned is true also if the fungus protease is in part or entirely replaced by trypsin, papain, and/or by a bacterial protease whose optimum efficacy is at a pH between 6 and 9.

The enzymatic efficacy of all proteases used is determined by one particular method, preferably according to Loehlein-Vollhardt (Collegium 1932, p. 404, Gerbereichemisches Taschenbuch by A. Kuenzel, 1955, p. 85.)

As is known in the art, the activity of protein-cleaving enzymes is determined by different methods. The best known methods are the Anson-hemoglobin method and the aforementioned Loehlein-Vollhardt method employing the hydrolytic decomposition of casein. In the first case, a protease unit is defined as that amount of enzyme which decomposes hemoglobin under certain given standard conditions with such an initial velocity that such an amount of decomposition products which cannot be precipitated with trichloroacetic acid is released per minute as gives the same color intensity as one milliequivalent of tyrosine with phenol reagent.

The Loehlein-vollhardt unit is defined as that amount of enzyme which digests 1.725 mg of casein under the test conditions established for this method. Both methods are suitable for determining the activity of the fungus proteases and bacterial proteases to be used according to the invention.

At present, no satisfactory explanation can be given for the clearly synergistic effect which comes into play when the two types of proteases are employed, in contrast to the use of the materials individually. It should, however, be repeated that the consolidation of various beamhouse methods into one procedure cannot be achieved using the designated fungus proteases alone, nor by using the aforementioned bacterial proteases alone. This is also true if the proteases are used individually with an activator or an activator mixture of the type described above.

It should be noted that extensive attempts to prepare tannable pelts from softened or unsoftened hides by the influence of a protease, particularly available under the tradename "Alkalase", having an optimum effect at a pH greater than 9 has produced unsatisfactory results since pelts which do not have grain damage cannot be prepared in this manner. With reference to the paper read at the IULCS-Congress in Prague in 1971 by I. R. Yates, entitled "Studies in Depilation", Larsson reports on page 46 of "Das Leder", March (1972) that dehairing with "Novoenzym" was insufficient and that leather prepared from a hide dehaired in this way was very slack and soft and showed clear attack of the grain. "Novoenzym" is a protease which can be prepared according to German patent publication 1,800,508, mentioned several times herein. The cited publication demonstrates that a treatment of skins only with bacterial proteases having an optimum efficacy above a pH of 9 has not yet lead to a satisfactory dehairing.

Although the advantage of the new process is primarily that the treatment of skins and hides to transform them into tannable pelts proceeds in one operation (i.e. in one vat or mixer), it can be advantageous to add one of the two proteases, or both, as well as the activator and/or an alkalinizing agent by feeding it in during the process. These are measures which again depend on the kind of skin being treated and whose utility in a particular case will be readily recognized by one skilled in the art.

The new process has the following advantages in comparison with the aforementioned processes: the treatment time is considerably shorter than when the individual processes are carried out serially, one step after another. The treatment of the two halves of a salted cowskin according to a conventional process and according to the process of the present invention requires the following times:

| | |
|---|---|
| (A) Conventional: | |
| Enzymatic softening | 4 – 5 hours |
| Enzymatic hair loosening followed by mechanical dehairing | 16 – 18 hours |
| Opening of the hide structure and akaline swelling, followed by mechanical fleshing | 16 – 18 hours |
| Subsequent enzymatic bating and rinsing | 1 – 2 hours |

The duration of the seven method steps takes 48 hours. The amount of water consumed is 900 percent, calculated on the weight of the skins being treated.

| | |
|---|---|
| (B) New Method: | |
| Washing of the skin | 1 hour |
| Enzymatic liming, followed by mechanical fleshing | 16 – 18 hours |

The duration of the three method steps is about 20 hours and the water consumption is 400 percent.

Hair loosening is carried out to such an extent that a mechanical dehairing, necessary in prior art enzymatic processes, is not necessary. There is no destruction of the hair, and most often the hair can be caught by a sieve when the vat or mixer is unloaded and separated in this manner from the waste water. In this way, there is a decisive decrease in the biological oxygen demand in the biological preparation of the waste water. The waste water arising in carrying out the process of the present invention, with the exception of small amounts of sulfide which arise during enzymatic decomposition by cleavage of disulfide bridges of cystine during hair loosening, is free of sulfide since there is no need for lime painting or liming with sodium sulfide.

The pelt obtained is free of short hairs and is completely free of scud and dirt so that the subsequent processes of tanning, coloring, and fat liquoring can be carried out easily and with the production of a leather of high quality.

The following examples illustrate the method of the present invention but the scope of the invention is not to be limited to these specific embodiments. Expressly to be included within the scope of the invention is the preparation of tannable pelts which are prepared directly from the skins obtained on slaughtering, i.e. without any prior preservation. One skilled in the art does not require to be advised that the treatment of dried skins requires a longer treatment with the bath of the composition of the present invention than is necessary for the treatment of skins and hides which have only been preserved by salting.

As discussed in detail in Examples 9 and 11, the process of the present invention can also be carried out in such a manner that, in addition to the alkaline bacterial proteases which are used in each case, several of the protein-cleaving enzymes wich are also to be used according to the present invention can be dissolved in the treating bath. In Example 9, a neutral bacterial protease is employed in combination with trypsin. In Example 11, papain and trypsin, in each case with an alkaline bacterial protease, are employed. It should be mentioned that the activity of the fungus proteases, bacterial proteases, and of trypsin are given in Loehlein-Vollardt-Units (LVU), while the activity of the papain used in Examples 10 – 12 is determined according to the Ansonhemoglobin method and the measured activity is designated in ASU.

EXAMPLE 1

100 kg of salted black-and-colored cowhide are introduced into a vat and combined with 200 percent by weight of water. After standing for 30 minutes, they are stirred for 30 minutes and subsequently the liquid is drained. Thereafter, the following are added to the vat and stirred for 10 minutes:

50 percent water having a temperature of 30° C. when introduced;
0.023 percent alkaline bacterial protease[x] (77,000 LVU);
0.05 percent alkaline fungus protease[xx] (140,000 LVU);
0.33 percent sodium sulfate;
0.1 percent sodium carbonate (calcined);
0.5 percent dimethylamine solution (60 percent);
0.5 percent mercapto-ethanol solution (50 percent);
0.3 percent of caustic soda priorly dissolved in a five-fold amount of water.

[x] from *Bacillus subtilis*
[xx] from *Aspergillus niger*

The skins are treated in this bath for five hours with turning every ½ hour. The pH value of the bath is at first 11.5 and after 5 hours is 10.5. At this point, 1.0 percent of caustic soda, priorly dissolved in a five-fold amount of water, and 4 percent of hydrated lime are added and the hides are stirred for 60 minutes.

After standing for 30 minutes, 150 percent of water at a temperature of 30° C. is added and the hides are stirred again for 30 minutes.

The percentages given above all are by weight of the salted hides employed.

The total treatment time is 18 hours. It is advantageous, even during the periods of standing, to agitate the hides several times for 3 – 5 minutes.

The pelts are now fleshed in the usual manner. They are soft and swollen and are completely free of pigment and short hairs.

EXAMPLE 2

100 kg of salted cowhides are covered with 200 percent of water and agitated for one hour. The bath is then drawn off. For preparing tannable pelts, the hides are next treated with:

30 percent of water having a temperature of 30° C. when introduced;
0.012 percent of alkaline bacterial protease[x] (77,000 LVU);
0.025 percent of alkaline fungus protease[xx] (140,000 LVU);
0.16 percent of sodium sulfate;
0.05 percent of sodium carbonate (calcined);
1 percent of dimethylamine solution (60 percent);
0.8 percent of sodium hydroxide (33 percent, diluted before addition with the same amount of cold water and stirred for 10 minutes).

[x] from *Bacillus alcalophilus*
[xx] from *Aspagillus flavus*

At 30 minute intervals, the hides are agitated for a period of 5 minutes. The pelts remain in this bath at first for 5 hours. At the beginning, a pH value of 11.0 is measured. After 5 hours, the pH value is 10.2. At this point, 3 percent of sodium hydroxide solution (33 percent diluted in advance with the same amount of water) and 2 percent of hydrated lime are added. The pelts are now agitated for 60 minutes and subsequently left to stand for 30 minutes. After the addition of 150 percent of water at a temperature of 30° C., the hides are agitated again for 30 minutes. During the remaining treatment time of 10 – 12 hours, the hides are agitated several times for 3 – 5 minutes each.

The percentages referred to are based on the weight of the salted hides.

The fleshed pelt is free of short hairs, has only shallow fat wrinkles, and no longer shows any pigmentation.

EXAMPLE 3

100 kg of fresh black-and-colored calfskins are washed with agitation for one hour with 200 percent of water. After withdrawal of the bath, the following are added and agitation takes place for ten minutes:

40 percent of water at a temperature of 30° C. when introduced;
0.023 percent of alkaline bacterial protease[x] (77,000 LVU);
0.05 percent of alkaline fungus protease[xx] (140,000 LVU);
0.33 percent of sodium sulfate;
0.10 percent of sodium carbonate;
0.05 percent of dimethylamine solution (60 percent);
0.5 percent of mercapto-ethanol solution (50 percent);
0.3 percent of caustic soda (dissolved beforehand in a five-fold amount of cold water).

[x] from *Streptomyces spec.*
[xx] from *Aspergillus niger*

After this time period, the hides are agitated at 30 minute intervals for about 5 minutes each time. The pH value at the beginning is 11.5: after 5 hours, it is 10.8. At this point, 1 percent of caustic soda, priorly dissolved in a five-fold amount of water, and 1.5 percent of calcium chloride are added and the hides are agitated for 30 minutes. After another 30 minutes standing, 160 percent of water at 30° C. is added to the vat. Then the hides are agitated again for 30 minutes. During the remaining treatment time of 10 – 12 hours, it is advantageous to agitate the hides several times for 3 – 5 minute intervals.

The percentages given are based on the weight of the fresh hides.

The fleshed calf pelts are free of grain contraction, are moderately swollen, and give a particularly good area yield.

EXAMPLE 4

10 kg of salted oxhides are introduced into a concrete mixer and directly treated for five hours with:

50 percent of water (30° C.);
0.023 percent of alkaline bacterial protease[x] (77,000 LVU);
0.05 percent of alkaline fungus protease[xx] (140,000 LVU);
0.33 percent of sodium sulfate;
0.1 percent of sodium carbonate;
0.5 percent of dimethylamine solution (60 percent);
0.5 percent of mercapto-ethanol solution (50 percent); and
0.3 percent of caustic soda (previously dissolved in a five-fold amount of water).

[x] from *Bacillus subtilis*
[xx] from Aspergillus niger

The hides are agitated in this bath for an initial period of 10 minutes, and then are agitated for a period of 5 minutes every half hour. The pH value at the beginning is 11.3: the pH value after 8 hours is 10.4.

Now, 1.0 percent of caustic soda, priorly dissolved in a five-fold amount of water, and 2 percent of hydrated lime are added and the hides are agitated for 60 minutes. After standing for 30 minutes, 150 percent of water at 30° C. is added to 200 percent of bath and the hides are agitated for another 30 minutes. During the remaining treatment time of 13 hours, the hides are stirred several times for 5 minute periods.

The percentages given refer to the weight of the salted hides.

Even the pelts treated in the concrete mixer show shallow fat wrinkles, are free of contraction and are completely dehaired.

EXAMPLE 5

100 kg of dried Chinese goatskins are introduced into a bath and stirred at two revolutions per minute for 3 hours with the following bath:

500 percent of water (40° C.);
5.0 percent of sodium chloride;
0.115 percent of alkaline bacterial protease[x] (77,000 LVU);
0.25 percent of alkaline fungus protease[xx] (140,000 LVU);
0.5 percent of sodium carbonate;
1.6 percent of sodium sulfate;
2.5 percent of dimethylamine solution (60 percent);
2.5 percent of mercapto-ethanol solution (50 percent);
0.5 percent of nonylphenol + 8.5 mols of ethylene oxide/mol, as a wetting agent; and
1.0 percent of caustic soda (priorly dissolved in a five-fold amount of cold water).

[x] from *Bacillus subtilis*
[xx] from *Aspergillus orycae*

Thereafter, 6.0 percent of calcium chloride and 6.0 percent of caustic soda, priorly dissolved in a ten-fold amount of water, are added and the hides are stirred for two additional hours at 10 rpm. Thereafter, 500 percent of water at 30° C. are introduced and the hides are stirred at 10 rpm for a further 30 minutes. The total treatment time amounts to 22 hours, during which it is suitable to agitate for five minute periods even during the periods of standing.

The percentages given refer to the weight of the dried skins.

It should be mentioned that dried goatskins can be converted into tannable pelts in less than 24 hours.

EXAMPLE 6

100 kg of dried salted sheepskins are introduced into a vat and treated for 3 hours at 2 rpm with:

500 percent of water (40° C.);
5 percent of sodium chloride;
0.115 percent of alkaline bacterial protease[x] (77,000 LVU);
0.250 percent of alkaline fungus protease[xx] (140,000 LVU);
0.5 percent of sodium carbonate;
1.6 percent of sodium sulfate;
5.0 percent of dimethylamine solution (60 percent); and
1.0 percent of caustic soda (priorly dissolved in a five-fold amount of cold water).

[x] from *Bacillus subtilis*
[xx] from *Aspergillus flavus*

After this time, 4.0 percent of hydrated lime and 6.0 percent of caustic soda, priorly dissolved in a 10-fold amount of water, are added and the hides are agitated for a further two hours at 10 rpm. Thereafter 500 percent of water at 30° C. are added and the hides are stirred for a further 30 minutes at 10 rpm. The total treatment time amounts to 22 hours, during which period it is suitable to agitate the hides several times for five minute periods.

The percentages given are by weight of the skins.

the pelts are white, free of short hairs, and no longer show any pigmentation.

EXAMPLE 7

100 kg of salted red oxhides are introduced into a vat and combined with 200 percent of water. After standing for 30 minutes, the hides are agitated for 30 minutes and the bath is subsequently drained.

For enzyme treatment, the following bath is added and the hides are agitated for 10 minutes:

50 percent of water (30° C. on introduction);
0.023 percent of alkaline bacterial protease[x] (77,000 LVU);
0.025 percent of alkaline fungus protease[xx] (140,000 LVU);
0.02 percent trypsin (250,000 LVU);
0.1 percent of sodium carbonate (calcined);
0.5 percent of dimethylamine solution (60 percent);
0.5 percent of mercapto-ethanol solution (50 percent); and
0.3 percent of caustic soda, previously dissolved in a five-fold amount of water.

[x] from *Bacillus subtilis*
[xx] from *Aspergillus niger*

The skins are treated in this bath for five hours with stirring for a period of five minutes during each half hour. The bath at first has a pH value of 11.2: after five hours, the pH is 10.4.

Now, 1.0 percent of caustic soda, previously dissolved in a five-fold amount of water, and 3.0 percent of hydrated lime are added and the bath is stirred for 60 minutes. After 30 minutes standing, 150 percent of water at 30° C. is added and the hides are agitated for a further 30 minutes.

The percentages given pertain to the weight of the salted hides.

Total treatment time: 18 hours.

To achieve a uniform effect, stirring is carried out several times for from 3 – 5 minutes.

For removal of the sub-dermal connective tissue, the pelts are fleshed mechanically.

The pelts are characterized by a light color and are free of pigment and short hairs.

EXAMPLE 8

100 kg of salted bull hides are coated with 200 percent of water and slowly agitated for 1 hour. After draining the bath, the skins are next agitated for 10 minutes with the following:

30 percent of water (30° C. at introduction);
0.046 percent of alkaline bacterial protease[x] (77,000 LVU);
0.133 percent of neutral bacterial protease[xx] (100,000 LVU);
0.05 percent of sodium carbonate (calcined);
1.0 percent of dimethylamine solution (60 percent); and
0.8 percent of sodium hydroxide solution (33 percent, diluted before addition with an equal amount of cold water).

[x] from *Bacillus subtilis*
[xx] from *Bacillus cereus*

The pelts remain in this bath for 5 hours and are stirred every hour for 10 minutes. The pH of the bath at the beginning is 10.8: after 5 hours, the pH is 10.3. At this point, 3 percent of sodium hydroxide solution (33 percent, diluted before addition with the same amount of cold water) and 1.5 percent of hydrated lime are added.

The hides are stirred for 60 minutes and subsequently left to stand for 30 minutes.

After the addition of 150 percent of water at 30° C., the hides are agitated again for 30 minutes.

The pelts remain in this bath for a total of b 16 hours.

The uniform removal of hair is improved by agitating the hides briefly for 3 – 5 minutes several times.

The amounts and percentages given pertain to the weight of the salted hides.

The flesh skin is soft-swollen and shows no grain contraction on its sides.

EXAMPLE 9

100 kg of salted calfskins are introduced into a concrete mixer and directly treated for 5 hours with:

50 percent of water (30° C.);
0.023 percent of alkaline bacterial protease[x] (77,000 LVU);
0.066 percent of neutral bacterial protease[xx] (100,000 LVU);
0.020 percent of trypsin (250,000 LVU);
0.1 percent of sodium carbonate (calcined);
0.5 percent of dimethylamine solution (60 percent);
0.5 percent of mercapto-ethanol solution (50 percent); and
0.3 percent of caustic soda (priorly dissolved in a five-fold amount of water).

[x] from *Bacillus subtilis*
[xx] from *Bacillus natto*

At the beginning, the hides are agitated for 10 minutes and then for 5 minutes each half hour.

The pH value at the beginning is 11.3: after 5 hours, it is 10.3.

1.0 percent of caustic soda, priorly dissolved in a five-fold amount of water, is now added together with 2.0 percent of hydrated lime and the mixture is agitated for 60 minutes. After 30 minutes standing, an additional 150 percent of water is added at 30° C. and the hides are agitated for another 30 minutes.

The remaining treatment time is 13 hours. During this time, the mixture is agitated several times for 5 minute intervals.

The percentages given pertain to the weight of the salted hides.

The pelts obtained are smooth and free of short hairs.

EXAMPLE 10

100 kg of red salted calfskins were washed with 200 percent of water for 1 hour with occasional stirring. Enzyme treatment in a vat followed by the addition, and stirring for 10 minutes, of:

- 40 percent of water (30° C. at introduction);
- 0.046 percent of alkaline bacterial protease[x] (77,000 LVU);
- 0.08 percent papain (50,000 ASU);
- 0.1 percent of sodium carbonate (calcined);
- 0.5 percent of dimethylamine solution (60 percent);
- 0.5 percent of mercapto-ethanol solution (50 percent); and
- 0.3 percent of caustic soda (priorly dissolved in a five-fold amount of water).

[x] from *Bacillus subtilis*

Every half hour, the hides were agitated for 5 minutes.

The pH value at the beginning was 11.2. After 5 hours, the pH was 10.8.

1.0 percent of caustic soda, priorly dissolved in a five-fold amount of water, and 1.5 percent of calcium chloride were now added and the hides were agitated for 30 minutes. After 30 minutes standing, a further 160 percent of water at 30° C. is added.

After a further stirring for 30 minutes, the hides are treated for an additional 12 hours.

During this time, the skins should be agitated several times for 3 – 5 minutes.

The percentages given pertain to the weight of the salted hides.

The fleshed hides show a low degree of swelling and thus have an above average area yield.

EXAMPLE 11

100 kg of salted calfskins are washed for 1 hour with 200 percent of water. A following enzyme treatment was carried out by agitating the hides for 10 minutes in a bath comprising:

- 30 percent of water (30° C. when introduced);
- 0.023 percent of alkaline bacterial protease[x] (77,000 LVU);
- 0.02 percent of papain (50,000 ASU);
- 0.02 percent of trypsin (250,000 LVU);
- 0.05 percent of sodium carbonate (calcined);
- 1.0 percent of dimethylamine solution (60 percent); and
- 0.8 percent of sodium hydroxide solution (33 percent, diluted prior to addition with the same amount of cold water).

[x] from *Bacillus subtilis*

The skins are left in this bath for 5 hours and stirred for 5 minutes at 30-minute intervals.

The pH of the bath at the beginning is 10.9: after 5 hours, it is 10.1.

3.0 percent of sodium hydroxide solution (33 percent, diluted before addition with the same amount of cold water) and 2.0 percent of hydrated lime are added to the same bath. After agitating for 60 minutes, the skins are left to stand for 30 minutes after which 150 percent of water at 30° C. is added.

Thereafter, the hides are agitated once more for 1 hour.

During the remaining treatment time of 10 hours, the hides should be briefly agitated often.

The percentage values are percents by weight of the salted hides.

The pelts obtained after fleshing have shallow fat wrinkles and are free of pigment and short hairs.

EXAMPLE 12

100 kg of salted cowhides are first washed for 1 hour in a vat with 200 percent of water at 20° C. The bath is then thrown out. Enzyme treatment followed with:

- 40 percent of water (30° C. as introduced);
- 0.023 percent of alkaline bacterial protease from *Bacillus' subtilis*(77,000 LVU);
- 0.066 percent of neutral bacterial protease from *Bacillus cereus* (100,000 LVU);
- 0.04 percent papain (50,000 ASU);
- 0.3 percent of caustic soda (dissolved prior to addition in a five-fold amount of water); and
- 0.15 percent of sodium sulfhydrate powder (95 percent NaSH) as an activator for papain, and 1.0 percent triethylamine solution (50 percent).

The treatment time lasted 6 hours. Every half hour, the hides are agitated for 5 minutes. The pH value at the beginning of the process is 11.4: after 5 hours, the pH is 10.8.

Now, 1.0 percent of caustic soda, priorly dissolved in a five-fold amount of water, and 1.0 percent of hydrated lime are added and agitated for 60 minutes. After 30 minutes, 100 percent of water at 30° C. are added and stirring is carried out for a further 30 minutes.

The percentages given are by weight of the salted hides.

The total treatment time amounts to 20 hours. During the standing periods, the hides are agitated for 5 minute periods at 4 rpm in three-hour intervals.

The pelts obtained after fleshing are completely dehaired and have only a very small degree of swelling and shallow fat wrinkles. The low degree of swelling leads to a particularly advantageous area yield in the finished leather.

EXAMPLE 13

100 kg of salted black-and-colored cowhides are introduced into a drum and combined therein with 200 percent of water at 25° C. After 30 minutes standing, the hides were paddled for 30 minutes. Then the bath is removed.

For enzyme treatment, the following bath is introduced and the hides are agitated for 30 minutes:

- 200 percent of water (28° C. at introduction);
- 0.023 percent of alkaline bacterial protease[x] (77,000 LVU);
- 0.025 percent of alkaline fungus protease[xx] (140,000 LVU);

0.02 percent of trypsin (250,000 LVU);
1.0 percent of dimethylamine solution (60 percent); and
0.8 percent of caustic soda (dissolved in a ten-fold amount of water prior to introduction).

* from *Bacillus subtilis*
** from *Aspergillus niger*

The hides remain in this bath overnight and are, during this time, agitated several times for 5 minute periods. The pH value of the bath is 11.0 at the beginning and is 9.8 the next morning. At this time, 1.0 percent of calcined lime, 2.0 percent of caustic soda, priorly dissolved in a ten-fold amount of water, and 2.0 percent of mercapto-ethanol solution (50 percent) are added and the hides are agitated for 40 minutes.

The total treatment time amounts to 36 hours. During the remaining time, the hides are again agitated several times for 5 minute periods. After 36 hours, the pelts are free of hair, are soft and are sufficiently swelled. Short hairs and scud are so well loosened that they are removed by agitation during deliming.

The percentages given are by weight of the salted hides.

EXAMPLE 14

100 kg of salted black-and-colored cowhides are introduced into a mixer and combined with 70 percent of water. After standing for 30 minutes, they are agitated for 10 minutes and are left to stand for 1 hour before they are agitated again. Subsequently the liquid is drained.

Enzyme treatment follows by the addition of:
50 percent of water, having a temperature of 30° C. when introduced;
0.023 percent alkaline bacterial protease from *Bacillus subtilis* (77,000 LVU);
0.04 percent trypsin (250,000 LVU);
0.1 percent sodium sodium carbonate (calcined);
0.8 percent diethylamine;
0.5 percent mercapto-propanol solution (50 percent);
0.3 percent caustic soda priorly dissolved in a five-fold amount of water.

Agitation takes place for 10 minutes.

Treatment in this bath takes 5 hours with turning every ½ hour for 5 minutes. The pH value at the beginning is 11.3; after 5 hours it is 10.5.

At this point 1 percent of caustic soda, priorly dissolved in a five-fold amount of water, and 3 percent of calcium hydroxide are added and the hides are agitated for 60 minutes.

After 30 minutes standing, 50 percent of water at 30° C. is added. Then the hides are agitated again for 30 minutes.

The percentages given are based on the weight of the salted hide.

The total treatment time amounts to 20 hours.

EXAMPLE 15

100 kg of salted red calfskins are introduced into a vat and covered with 200 percent of water at 25° C. After standing for 30 minutes the skins are agitated for 30 minutes. Subsequently the bath is drained.

Enzyme treatment follows by the addition of:
200 percent of water, having a temperature of 28° C. when introduced;
0.023 percent alkaline bacterial protease from *Bacillus subtilis* (77,000 LVU);
0.025 percent alkaline fungus protease *Aspergillus niger* (140,000 LVU);
0.02 percent trypsin (250,000 LVU);
2.0 percent diethylamine;
0.8 percent caustic soda priorly dissolved in a ten-fold amount of water, and agitation takes place for 30 minutes.

The skins remain in this bath over night and are, during this time, agitated several times for 5 minute periods. The initial pH value of the bath is 11.0 and is 9.8 the next morning.

At this time, 1.0 percent of calcium hydroxide, 2.0 percent of caustic soda, priorly dissolved in a ten-fold amount of water, and 2.0 percent of mercapto-ethanol solution (50 percent) are added and the skins are agitated for 40 minutes.

The total treatment time amounts to 36 hours. During the remaining time, the skins are again agitated several times for 5 minutes.

After 36 hours the pelts are free from hair, soft and sufficiently swelled. The scud is so well loosened that it is removed by agitation during deliming.

The percentages given are by weight of the salted hides.

EXAMPLE 16

100 kg of salted bull hides are introduced into a vat and covered with 200 percent of water at 25° C. After standing for 30 minutes the hides are agitated for 30 minutes. Then the bath is drained.

Enzyme treatment follows by the addition of:
200 percent of water (28° C at introduction);
0.023 percent alkaline bacterial protease from *Bacillus subtilis* (77,000 LVU);
0.025 percent alkaline fungus protease from *Aspergillus niger* (140,000 LVU);
0.02 percent trypsin (250,000 LVU);
1.5 percent monoethylamine;
0.8 percent caustic soda priorly dissolved in a ten-fold amount of water;

wherein the hides are agitated for 30 minutes.

The hides remain in this bath overnight and, during this time are, agitated several times for 5 minute periods. The pH value of the bath is 11.0 at the beginning and 9.8 the next morning. At this time, 1.0 percent of calcium hydroxide, 2.0 percent of caustic soda, priorly dissolved in a ten-fold amount of water, and 2.0 percent sodium thioglycolate solution are added and the hides are agitated for 40 minutes.

The total treatment time amounts to 36 hours. During the remaining time, the hides are again agitated several times for 5 minute periods. After 36 hours, the pelts are free of hair, soft and sufficiently swelled. The scud is so well loosened that it is removed by agitation during deliming.

The percentages given are by weight of the salted hides.

EXAMPLE 17

100 kg of salted heifer hides are introduced into a vat and covered with 200 percent of water 25° C. After standing for 30 minutes, the hides are agitated for 30 minutes. Thereafter the bath is drained.

Enzyme treatment follows by the addition of:
200 percent of water (28° C. at introduction);
0.023 percent alkaline bacterial protease from *Bacillus subtilis* (77,000 LVU);

0.025 percent alkaline fungus protease from *Aspergillus flavus* (140,000 LVU);
0.02 percent trypsin (250,000 LVU);
2.0 percent monomethylamine solution (40 percent);
0.8 percent caustic soda, priorly dissolved in a 10-fold amount of water;

wherein the hides are agitated for 30 minutes.

The hides remain in this bath overnight and are, during this time, agitated several times for 5 minute periods. The pH value of the bath is 11.0 at the beginning and 9.8 the next morning. At this time, 1.0 percent of calcium hydroxide, 2.0 percent of caustic soda, priorly dissolved in a 10-fold amount of water, and 2.0 percent of mercaptoethanol solution (50 percent) are added, and the hides are agitated for 40 minutes.

The total treatment time amounts to 36 hours. During the remaining time, the hides are again agitated several times for 5 minute periods. After 36 hours the pelts are free of hair, soft and sufficiently swelled. The scud is so well loosened that it is removed by agitation during deliming.

The percentages are given by weight of the salted hides.

EXAMPLE 18

100 kg of salted red oxhides are introduced into a drum and combined with 200 percent of water. After standing for 30 minutes, the hides are agitated for 30 minutes and then the bath is drained.

For enzyme treatment the following bath is added and the hides are agitated for ten minutes:

50 percent of water (30° C. at introduction);
0.023 percent alkaline bacterial protease from *Bacillus subtilis*(77,000 LVU);
0.025 percent alkaline fungus protease from *Aspergillus parasiticus* (140,000 LVU);
0.02 percent trypsin (250,000 LVU);
0.1 percent sodium carbonate (calcined);
2.0 percent monoethanolamine;
0.5 percent mercapto-ethanol solution (50 percent); and
0.3 percent caustic soda, previously dissolved in a five-fold amount of water.

The hides are treated in this bath for 5 hours and are moved every half hour for five minutes. The bath at first has a pH value of 11.2, after 5 hours it is 10.4.

At this point, 1.0 percent of caustic soda, previously dissolved in a five-fold amount of water, and 3.0 percent of calcium hydroxide are added and the hides are stirred for 60 minutes.

After standing for 30 minutes, 150 percent of water at a temperature of 30° C. are added and the hides are stirred again for 30 minutes.

The percentages given are by weight of the salted hides.

The total treatment time is 18 hours.

EXAMPLE 19

100 kg of salted red calfskins are introduced into a drum and combined with 200 percent of water. After standing for 30 minutes, they are agitated for 30 minutes and then the bath is drained.

For enzyme treatment the following bath is added and the hides are agitated for 10 minutes:

50 percent of water (30° C. at introduction);
0.023 percent alkaline bacterial protease from *Bacillus subtilis* (77,000 LVU);
0.025 percent alkaline fungus protease from *Aspergillus parasiticus* (140,000 LVU);
0.02 percent trypsin (250,000 LVU);
0.1 percent sodium carbonate (calcined);
2.0 percent diethanolamine;
0.5 percent mercapto-ethanol solution (50 percent); and
0.3 percent caustic soda, previously dissolved in a five-fold amount of water.

The skins are treated in this bath for 5 hours with moving every half hour for five minutes. The pH value of the bath is at first 11.2; and after 5 hours, 10.4. At this point, 1.0 percent of caustic soda, previously dissolved in a five-fold amount of water, and 3.0 percent of calcium hydroxide are added and the skins are moved again for 30 minutes.

The percentages given are by weight of the salted hide.

The total treatment time is 18 hours.

what is claimed is:

1. A method for preparing tannable pelts from animal skins or hides, said method effecting concurrent softening, complete dehairing, opening of the hide structure, and bating in a single procedural step, which method comprises treating said skins or hides, free of preserving salt, with an aqueous bath having a pH between about 9 and about 12 and having dissolved therein:

a. an effective amount of at least one member selected from the group consisting of a fungus protease whose optimum efficacy towards casein is at a pH above 7.0, trypsin, papain, and a bacterial protease whose optimum efficacy is at a pH between 6 and 9;
b. an effective amount of a bacterial protease having an optimum efficacy against hemoglobin at a pH above 9; and
c. an effective amount of a short-chain primary or secondary aliphatic amine.

2. A method as in claim 1 wherein said bath additionally comprises an effective amount of an organic sulfur compound which is a reducing agent.

3. A method as in claim 2 wherein said organic sulfur compound is selected from the group consisting of mercapto-ethanol, mercapto-propanol, and thioglycollates.

4. A method as in claim 1 wherein the proteolytic activity of the fungus protease therein, measured in conventional units, is greater than that of the bacterial protease therein.

5. A method as in claim 1 wherein said fungus protease (a) is derived from *Aspergillus niger* or *Aspergillus flavus* and said bacterial protease (b) is derived from *Bacillus subtilis*.

6. A method as in claim 1 wherein said amine is dimethylamine.

* * * * *